US009856059B2

(12) United States Patent
Grant

(10) Patent No.: US 9,856,059 B2
(45) Date of Patent: Jan. 2, 2018

(54) CONTAINER WITH ABRASION RESISTANT RIM

(71) Applicant: Owens-Brockway Glass Container Inc., Perrysburg, OH (US)

(72) Inventor: Edward A Grant, Toledo, OH (US)

(73) Assignee: Owens-Brockway Glass Container INc., Perrysburg, OH (US)

( * ) Notice: Subject to any disclaimer, the term of this patent is extended or adjusted under 35 U.S.C. 154(b) by 28 days.

(21) Appl. No.: 14/997,147

(22) Filed: Jan. 15, 2016

(65) Prior Publication Data

US 2017/0203894 A1 Jul. 20, 2017

(51) Int. Cl.

| | |
|---|---|
| ***B65D 1/42*** | (2006.01) |
| ***B65D 53/06*** | (2006.01) |
| ***B65D 1/02*** | (2006.01) |
| ***B65D 1/10*** | (2006.01) |

(52) U.S. Cl.

CPC ..... *B65D 53/06* (2013.01); *B65D 1/023* (2013.01); *B65D 1/0207* (2013.01); *B65D 1/10* (2013.01)

(58) Field of Classification Search

CPC ..... B65D 55/06; B65D 51/20; B65D 2251/0093; B29C 65/00

USPC ..... 220/656

See application file for complete search history.

(56) References Cited

U.S. PATENT DOCUMENTS

| | | | | |
|---|---|---|---|---|
| 2,711,840 | A | 6/1955 | Gits et al. | |
| 4,044,941 | A | 8/1977 | Knudsen | |
| 4,180,961 | A | 1/1980 | Collins, III | |
| 4,396,655 | A | 8/1983 | Graham et al. | |
| 4,444,325 | A * | 4/1984 | Lecinski, Jr. | B65D 41/16 215/346 |
| 4,583,656 | A | 4/1986 | MacLaughlin | |
| 4,694,969 | A | 9/1987 | Granat | |
| 5,062,538 | A * | 11/1991 | Ochs | B65D 41/04 215/252 |
| 6,547,093 | B1 | 4/2003 | Messer et al. | |
| 6,802,919 | B2 | 10/2004 | Massey et al. | |
| 6,881,286 | B2 | 4/2005 | Drummond et al. | |
| 7,823,736 | B1 | 11/2010 | Pugne et al. | |
| 8,714,402 | B2 * | 5/2014 | Touchet | B29C 65/08 220/613 |
| 8,905,251 | B2 * | 12/2014 | Kornfeld | B32B 3/266 215/232 |
| 2009/0212060 | A1 * | 8/2009 | Shinohara | B65B 7/285 220/661 |
| 2011/0100988 | A1 | 5/2011 | Fraser et al. | |

(Continued)

FOREIGN PATENT DOCUMENTS

DE 3447573 A1 7/1986

OTHER PUBLICATIONS

PCT Search Report and Written Opinion, Int. Application. No. PCT/US2016/066260, Int. Filing Date: Dec. 13, 2016, Applicant: Owens-Brockway Glass Container Inc., dated Feb. 17, 2017.

*Primary Examiner* — Shawn M Braden

(57) ABSTRACT

A container includes a sidewall circumscribing a central longitudinal axis and a rim terminating the sidewall. The rim includes a radially outer surface, a radially inner surface, and a sealing lip extending between the radially outer and inner surfaces. The sealing lip has a radially innermost portion, and an axially outermost portion disposed radially outboard with respect to the radially innermost portion. A package includes a foil coupled to the sealing lip.

18 Claims, 3 Drawing Sheets

(56) References Cited

U.S. PATENT DOCUMENTS

| | | | | |
|---|---|---|---|---|
| 2013/0075356 | A1* | 3/2013 | Bergida | A47G 19/2205 215/329 |
| 2013/0193100 | A1 | 8/2013 | Lamoureux | |
| 2014/0332535 | A1 | 11/2014 | Grant et al. | |

* cited by examiner

CONTAINER WITH ABRASION RESISTANT RIM

The disclosure relates to containers that are sealed with a foil, wherein the rim is designed to preserve the integrity of the foil.

BACKGROUND AND SUMMARY OF THE DISCLOSURE

Whether required by law or regulation, or whether needed to preserve items being stored, many containers require a seal that is airtight and impervious to liquid. Typically, these types of seal include a layer of foil that covers the opening of the container and is secured thereto by an adhesive. A problem with a foil seal is that it can be compromised when items are stacked on top of the foil. Friction will abrade the foil seal, thereby compromising the foil seal by providing access to the interior of the container. This is illustrated in prior art FIG. 3, where a prior art embodiment of a sealed container A may have its foil seal B abraded and compromised due to a container C stacked above it. The abrasion in this example would occur at or near an inner diameter of the sealed container A, which would allow contents D to be exposed to the atmosphere and possible contaminants.

In accordance with one embodiment, a container includes a base establishing a base plane on which the container is restable and through which extends a container longitudinal axis, a sidewall extending from the base and circumscribing the longitudinal axis, and a rim terminating the sidewall and including radially inner and outer surfaces and a sealing lip extending between the radially inner and outer surfaces. A portion of the sealing lip proximate the outer surface is further from the base plane than another portion of the sealing lip proximate the inner surface.

In accordance with another embodiment, a container includes a sidewall circumscribing a central longitudinal axis and a rim terminating the sidewall. The rim includes a radially outer surface, a radially inner surface, and a sealing lip extending between the radially outer and inner surfaces. The sealing lip has a radially innermost portion, and an axially outermost portion disposed radially outboard with respect to the radially innermost portion.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION

Figure 1:
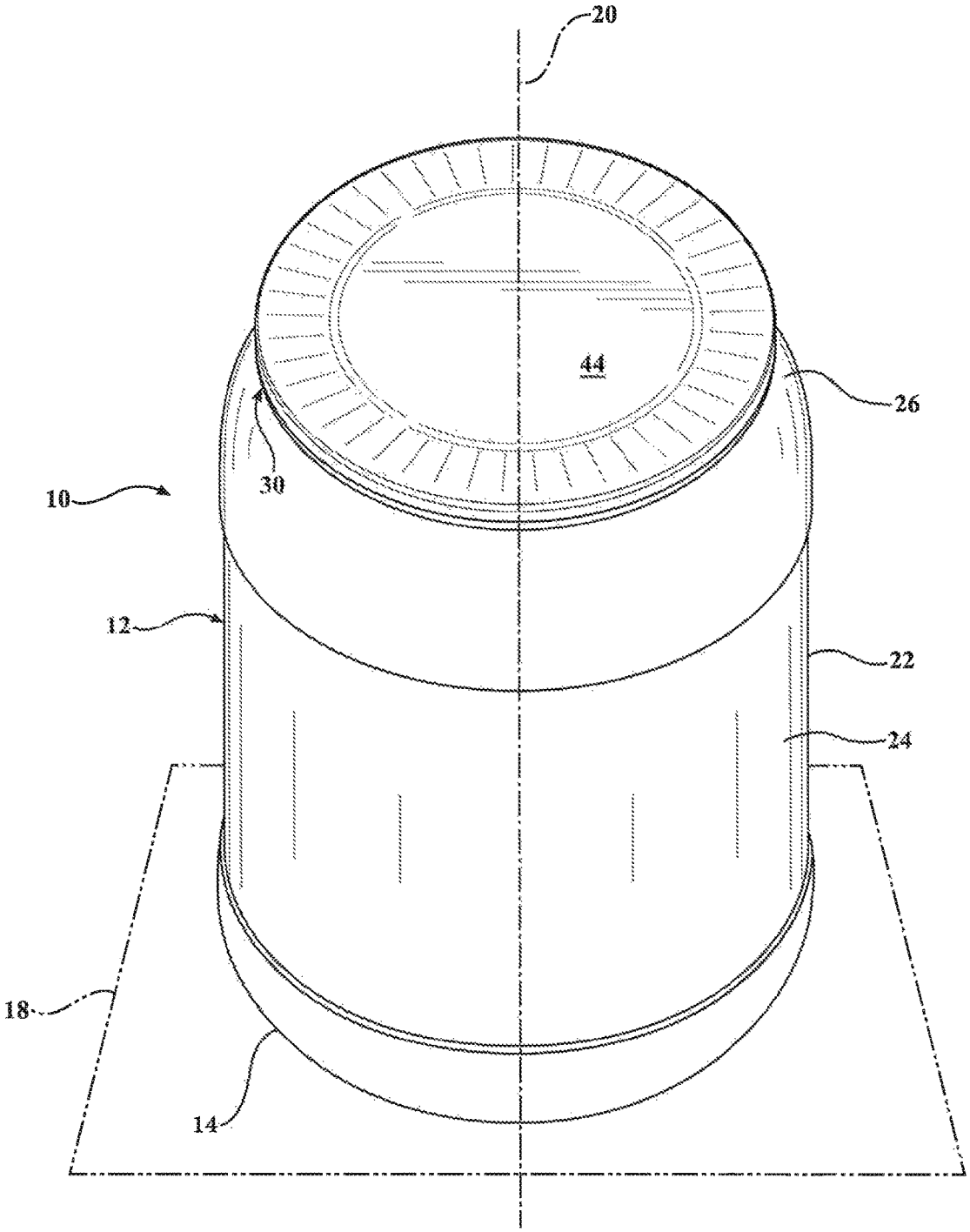
FIG. 1 is a perspective view of a package in accordance with an illustrative embodiment of the present disclosure and including a container and a sealing foil applied thereto.

Referring to FIG. 1, a package 10 includes a container 12 and a sealing foil 44 coupled to the container 12. In the illustrated embodiment, the container 12 may include a jar. In other embodiments, the container 12 may include a bowl, cup, or any other container suitable for accepting the sealing foil 44. The container 12 may be composed of glass, but other materials may be used to fabricate the container 12, including plastics, metals and the like. The container 12 may be of generally circular cross section, as illustrated, but may be of rectangular, square, polygonal, oval, or any other suitable cross-sectional shape.

In any case, the container 12 includes a base 14 that establishes a base plane 18 normal to a longitudinal axis 20 of the container 12. The base 14 need not be entirely flat and may include a push-up or punt.

Also, the container 12 may include a sidewall 22 extending away from the base 14 and circumscribing the axis 20. In the illustrated jar embodiment, the sidewall 22 may include a body 24 extending from the base 14, and a shoulder 26 extending from the body 24. Additionally, with reference to FIG. 2, the container 12 may include a neck 28 extending from the shoulder 26 (FIG. 1), and a neck finish 31 terminating the neck 28. The neck finish 31 may include what is known in the art as a "bead finish" as opposed to a threaded finish having threads and a transfer bead below the threads.

In any embodiment, the container 12 includes a rim 30 that terminates the sidewall 22. The rim 30 includes a sealing lip 32, a radially inner surface 34, and a radially outer surface 36. The inner surface 34 may extend at an oblique angle with respect to the central longitudinal axis 20, and the outer surface 36 may extend at an oblique angle with respect to the central longitudinal axis 20. These angles need not equal each other and may not even be complementary angles. However, in other embodiments (not shown), the inner 34 and outer 36 surfaces may extend generally parallel to the central longitudinal axis 20. The outer surface 36 may be tapered to extend in a radially outward and axially inward direction. The inner surface 34 may be tapered to extend in a radially and axially inward direction toward an inner cylindrical surface 37 of the container 12 with or without a step 39 therebetween.

The sealing lip 32 extends between the radially inner and outer surfaces 34, 36, and has a radially innermost portion 33, and an axially outermost portion 35 disposed radially outboard with respect to the radially innermost portion 33. The axially outermost portion 35 is the portion of the container 12 that is furthest from the base plane 18. The sealing lip 32 also includes an intermediate surface 38, which may be a straight surface that is radially and axially inwardly angled. The intermediate surface 38 may extend between the inner and outer surfaces 34, 36 at an oblique angle with respect to the central longitudinal axis 20. In other words, the intermediate surface 38 is not parallel to the base plane 18. The orientation of the inter intermediate surface 38 is such that a portion of the sealing lip 32 proximate the outer surface 36 (and distal the inner surface 34) is further from the base plane 18 (FIG. 1) than another portion of the scaling lip 32 proximate the inner surface 34 (and distal the outer surface 36). In the instance where the container 12 is sitting on its base 14 with the sidewall 22 extending upwardly, the intermediate surface 38 would be angled downwardly and inwardly with respect to the container 12. In other words, the intermediate surface 38 extends in a radially and axially inward direction at an angle that may be approximately five degrees (5°) with respect to a plane normal to the longitudinal axis. The angle may be between two and ten degrees, including all ranges and sub-ranges therebetween, or three and seven degrees, including all ranges and sub-ranges therebetween.

In the illustrated embodiment, the rim 30 may include an inner radiused portion 40 that may extend between the radially inner surface 34 and the intermediate surface 38, and an outer radiused portion 42 that may extend between the radially outer surface 36 and the intermediate surface 38. In other embodiments, the rim 30 may include other transitions of any other suitable shape.

The foil 44 is coupled or secured to the sealing lip 32 and may include a substrate 46 and also may include an adhesive layer 48 to facilitate coupling to the sealing lip 32. The substrate 46 may be composed of a metallic material, and the adhesive layer 48 may include a polymeric material or an adhesive carried by the substrate 46.

Figure 2:
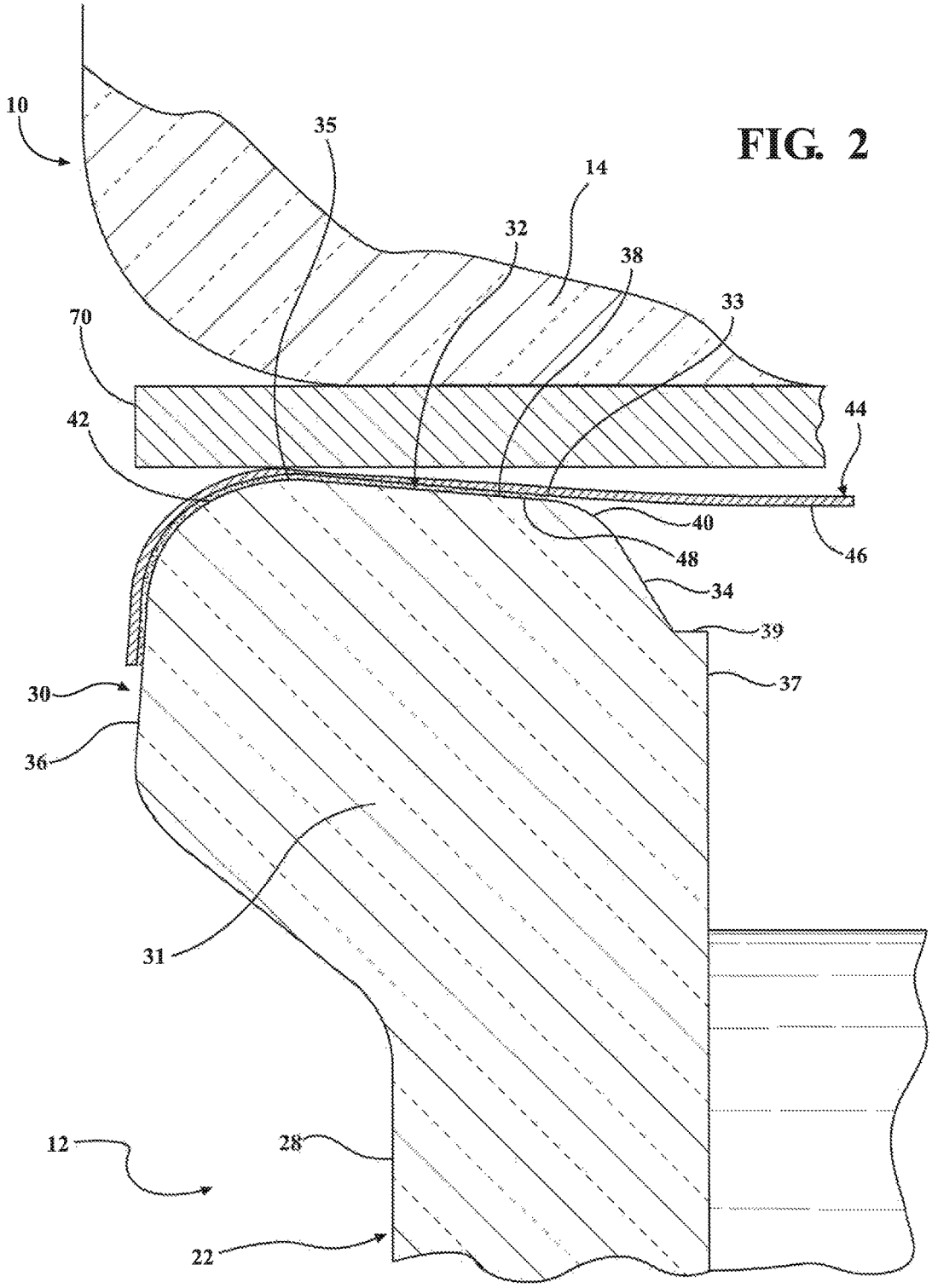
FIG. 2 is an enlarged, fragmentary, cross-sectional side view of the package of FIG. 1 with a tear sheet and another package stacked thereon.
Figure 3:
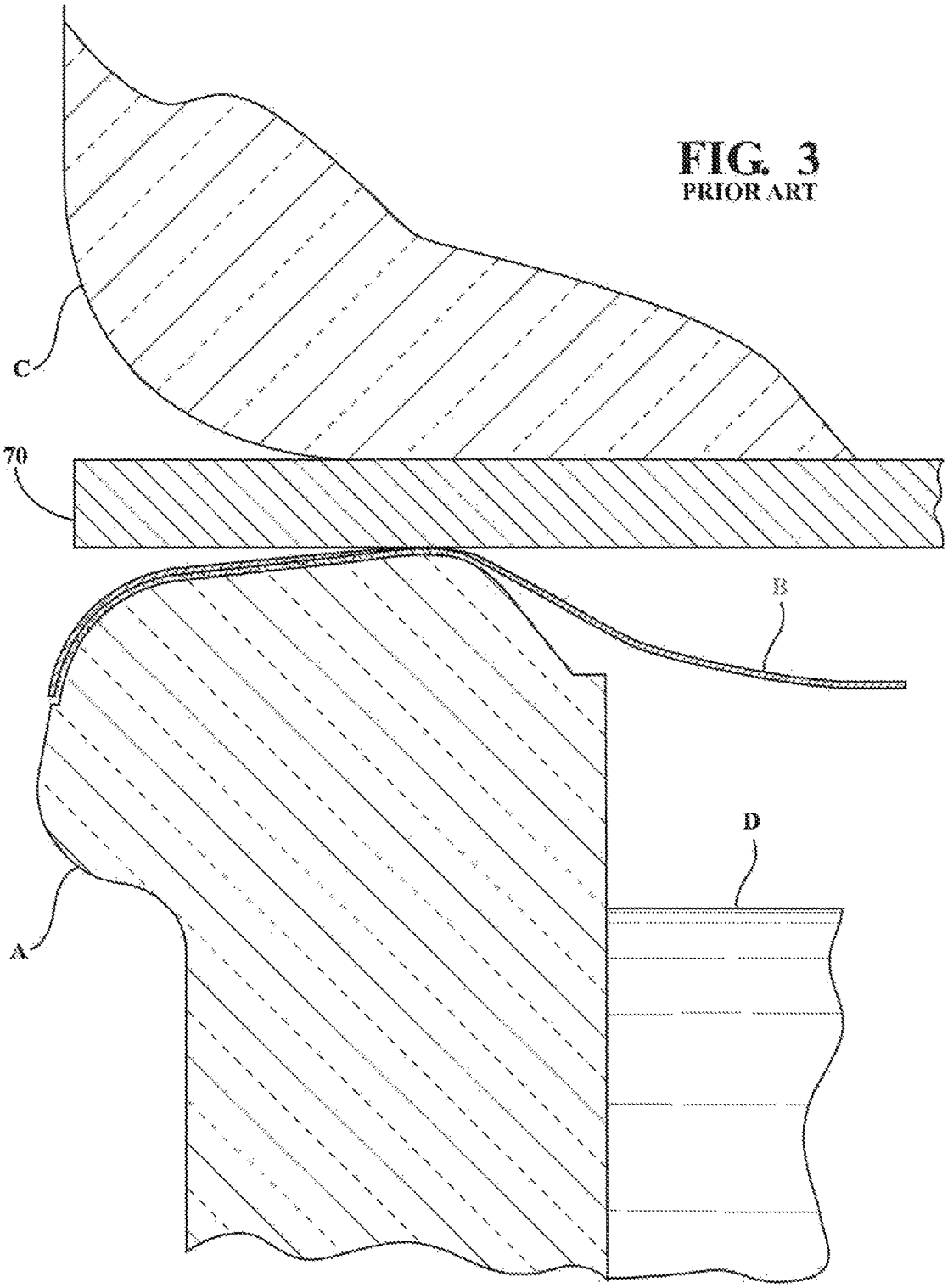
FIG. 3 PRIOR ART
FIG. 3 is a fragmentary, cross-sectional side view of prior art packages stacked on one another with a tear sheet therebetween.

As shown in FIG. 2, a plurality of the package 10 may be stacked with a tear sheet 70 inserted therebetween. To the extent that the tear sheet 70 may abrade the foil 44, it will do so proximate the axially outermost portion 35 of the sealing lip 32. If the foil 44 is compromised at this position, portions of the foil 44 located radially inwardly with respect to the abraded portion will remain unabraded and adhered to the intermediate surface 38 because the tear sheet 70 does not contact such portions of the intermediate surface 38, thus preserving the seal created by the foil 44 that extends radially inwardly of the outer periphery 42.

Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A glass container comprising:

a base establishing a base plane on which the container is restable and through which extends a container longitudinal axis;

a sidewall extending from the base and circumscribing the longitudinal axis; and a rim terminating the sidewall and including radially inner and outer surfaces and a sealing lip extending between the radially inner and outer surfaces and including an intermediate surface extending in a radially and axially inward direction, wherein a radially outermost portion of the intermediate surface of the sealing lip proximate the outer surface and distal the inner surface is further from the base plane than a radially innermost portion of the intermediate surface of the sealing lip proximate the inner surface and distal the outer surface, wherein the sealing lip is disposed at an angle between two and ten degrees with respect to a plane perpendicular to the longitudinal axis.

2. The container set forth in claim 1 wherein the intermediate surface is straight.

3. The container set forth in claim 1 wherein the sealing lip is configured to receive an adhesive layer thereon to affix a foil seal over the sealing lip to seal the container.

4. The container set forth in claim 1 wherein the sidewall includes a body extending from the base, a shoulder extending from the body, a neck extending from the shoulder, and a neck finish establishing the rim.

5. The container set forth in claim 1 wherein the sealing lip is disposed at an angle between three and seven degrees with respect to a plane perpendicular to the longitudinal axis.

6. A package comprising:

the container set forth in claim 1; and a foil secured to the sealing lip.

7. A package set forth in claim 6 wherein the foil includes a metal outer portion and a polymeric inner portion.

8. A glass container, comprising:

a sidewall circumscribing a central longitudinal axis; and a rim terminating the sidewall and including:

a radially outer surface, a radially inner surface, and a sealing lip extending between the radially outer and inner surfaces and having a radially innermost portion proximate the radially inner surface and distal the radially outer surface, and an axially outermost portion disposed radially outboard with respect to the radially innermost portion proximate the radially outer surface and distal the radially inner surface, and an intermediate surface that extends in a radially and axially inward direction, wherein the sealing lip is disposed at an angle between two and ten degrees with respect to a plane perpendicular to the longitudinal axis.

9. The container set forth in claim 8 wherein the intermediate surface is straight.

10. The container set forth in claim 8 wherein the sealing lip also has an outer radiused portion extending radially outwardly from the intermediate surface and an inner radiused portion extending radially inwardly from the intermediate surface.

11. The container set forth in claim 8 wherein the radially outer surface is tapered to extend in a radially outward and axially inward direction.

12. The container set forth in claim 8 wherein the sidewall includes a neck of the container, and wherein the rim includes a neck finish of the container.

13. The container set forth in claim 12 wherein the container is a jar.

14. A package comprising:

the container set forth in claim 8; and a sealing foil coupled to the sealing lip of the container rim.

15. A package set forth in claim 14 wherein the foil includes a metal outer portion and a polymeric inner portion.

16. A glass container comprising:

a base establishing a base plane on which the container is restable and through which extends a container longitudinal axis;

a sidewall extending from the base and circumscribing the longitudinal axis; and a rim terminating the sidewall and including:

a radially inner surface extending at an oblique angle with respect to the axis in a radially inward and axially inward direction, a radially outer surface extending at an oblique angle with respect to the axis in a radially outward and axially inward direction, and a sealing lip extending between the radially inner and outer surfaces and including:

a radially innermost portion proximate the radially inner surface and distal the radially outer surface, an axially outermost portion disposed radially outboard with respect to the radially innermost portion proximate the radially outer surface and distal the radially inner surface, and axially further from the base plane than the radially innermost portion, a straight intermediate surface extending in a radially and axially inward direction at an oblique angle between two and ten degrees with respect to a plane normal to the axis, an outer radiused portion extending radially outwardly from the intermediate surface to the radially outer surface of the rim, and an inner radiused portion extending radially inwardly from the intermediate surface to the radially inner surface of the rim.

17. A package comprising:

the container set forth in claim 16; and a sealing foil coupled to the sealing lip of the container rim.

18. A package set forth in claim 17 wherein the foil includes a metal outer portion and a polymeric inner portion.

* * * * *